United States Patent [19]

Moon

[11] Patent Number: 5,044,027

[45] Date of Patent: Sep. 3, 1991

[54] CUSHION CONSTRUCTION

[76] Inventor: Benny C. Moon, 145 Ludwell Ct., Alpharetta, Ga. 30201

[21] Appl. No.: 506,263

[22] Filed: Apr. 9, 1990

[51] Int. Cl.[5] ..... A47C 27/00

[52] U.S. Cl. ..... 5/448; 5/468; 5/480

[58] Field of Search ..... 5/439, 448, 461, 468, 5/474, 476, 480, 481

[56] References Cited

U.S. PATENT DOCUMENTS

| | | | |
|---|---|---|---|
| 2,321,790 | 6/1943 | Bass | 5/476 |
| 2,412,953 | 12/1946 | Auerbach | 5/448 |
| 3,012,256 | 12/1961 | Zerbee | 5/461 |
| 3,058,125 | 10/1962 | Zerbee | 5/461 |
| 3,618,144 | 11/1971 | Frey et al. | 5/448 X |
| 3,974,532 | 8/1976 | Ecchuya | 5/468 |
| 4,122,568 | 10/1978 | Bastos et al. | 5/448 |
| 4,407,031 | 10/1983 | Michiels | 5/481 X |
| 4,713,854 | 12/1987 | Graebe | 5/448 X |

FOREIGN PATENT DOCUMENTS

| | | | |
|---|---|---|---|
| 2055173 | 2/1981 | United Kingdom | 5/476 |

*Primary Examiner*—Michael F. Trettel
*Attorney, Agent, or Firm*—Donald W. Hanson

[57] ABSTRACT

A cushion such as a mattress for providing a surface for resting and sleeping. The cushion comprises a plurality of elongated tubular structures each having a longitudinal axis, the tubular structures being arranged in an array such that adjacent structures contact each other with their respective axes generally parallel and preferably in generally a common plane. The interior of each structure is open to the atmosphere and each structure is resilent in nature and has an upwardly extending rounded surface. The upper portions of the tubular structures together define a generally horizontal and planar sleeping surface. The cushion further includes confining means for maintaining the tubular structures in the arranged manner.

24 Claims, 5 Drawing Sheets

CUSHION CONSTRUCTION

The present invention relates to a construction for a cushion such as a mattress and, more particularly, to a cushion construction which incorporates a plurality of elongated tubular structures arranged together in a generally parallel relationship to provide a body support system such as a sleeping or resting surface, the tubular structures being of sufficient rigidity to maintain their general shape while bearing a load such a human body yet of sufficient flexibility to slightly deform under such a load without body sections such as the hips, thighs, midsection, chest and shoulders being affected by the other support components.

While the present invention will be discussed hereinafter primarily in reference to a construction for mattresses and the like, particularly mattresses used for sleeping or resting surfaces for the human body, it should be recognized and understood that the use and application of the present invention is not thereby so limited and the subject invention may find utility in other types of body support systems or cushions such as those used in furniture, e.g., sofas and chairs, as well as cushions for seats or like structures in automobiles, aircraft and other modes of transportation, and any other application where a comfortable supporting surface for the human body is desirable.

Over the years, many different types of mattresses have been developed with the ultimate aim of providing a resting or sleeping surface which provides sufficient support for all parts of the body such that the user arises refreshed and without aching parts of the body yet provides a surface which is sufficiently comfortable. As a general matter, it has been found that the most comfortable and restful type of mattress or sleeping surface is one that overall is sufficiently firm that all parts of the body are well supported and the body is maintained in a generally planar position yet provides sufficient flexibility that the mattress conforms to the shape of the body such that the mattress is comfortable.

Beyond a simple pad supported on a firm planar surface, efforts in producing a mattress of the characteristics as set forth above have tended to rely on various resilient means such as padded metallic springs, spongy type foam, and pneumatic articles filled at least in part with a fluid such as air and water. While all of these mattresses based on these resilient systems tend to perform most of their intended functions, such systems tend not to be the ideal solution for providing a restful supporting surface and are basically a compromise between firm support for all parts of the body and maximum comfort for the user. For example, a typical waterbed by its nature naturally conforms to shape of the human body and provides a hydrostatic support to all points of the body contacting the mattress. However, inasmuch that the prone human body is not uniform in its weight from end to end, the body tends to sink in the areas of greatest weight relative to the remainder of the body, that is, the torso generally tends to sink lower within the mattress than the head, legs or arms. As a consequence, the human body tends to repose in a nonlinear manner which can cause muscle and or joint stiffness and aching after a period of time on such a sleeping surface. In any of these situations, the intended purpose of obtaining a comfortable and refreshing rest period for the human body is not achieved to the maximum extent.

SUMMARY OF THE INVENTION

It is therefore a feature of the present invention to provide a body support system which, contrary to conventional support systems which are affected by the weight of the connecting sections of the body, is adapted for sitting, reclining or sleeping and offers independent support for the head, shoulders, chest, back, waist, hips, thighs, knees, calves and feet of the human body.

It is another a feature of the present invention to provide a construction for a body support system or cushion such as a mattress which tends to conform to the shape of the human body without being unduly soft or capable of forming a sagging type overall configuration.

It is another feature of the invention to provide a body support system such as a mattress which is constructed such that the mattress provides firm support for all contacting parts of the human body without pushing up excessively under various portions of the body, particularly under the small of the back.

It is a further feature of the invention to provide a mattress which is constructed such that the mattress is quite comfortable and provides a restful nights sleep for user and allows the user to arise refreshed and without any stiff or aching body parts caused by, for example, poor alignment support, compression or suppression of nerve and or capillary supply and the like.

It is also a feature of the present invention to provide a cushion such as a mattress which can be easily and simply constructed from relatively inexpensive materials and can be easily produced with conventional forming and manufacturing materials and equipment.

Briefly, in its broader aspects, the present invention comprehends a cushion comprising a plurality of elongated tubular structures each having a longitudinal axis, the tubular structures being arranged in an array such that adjacent structures contact each other and their respective axes are generally parallel and are preferably in a common plane, the interior of each structure being open to the atmosphere and each structure being resilient in nature and having an upwardly extending rounded surface, the upper portions of the tubular structures together defining a generally planar supporting surface, and confining means for maintaining the tubular structures in the arranged array.

Further features, objects and advantages of the present invention will become more fully apparent from a detailed consideration of the arrangement and construction of the constituent parts as set forth in the following description taken together with the accompanying drawings.

Figure 1:
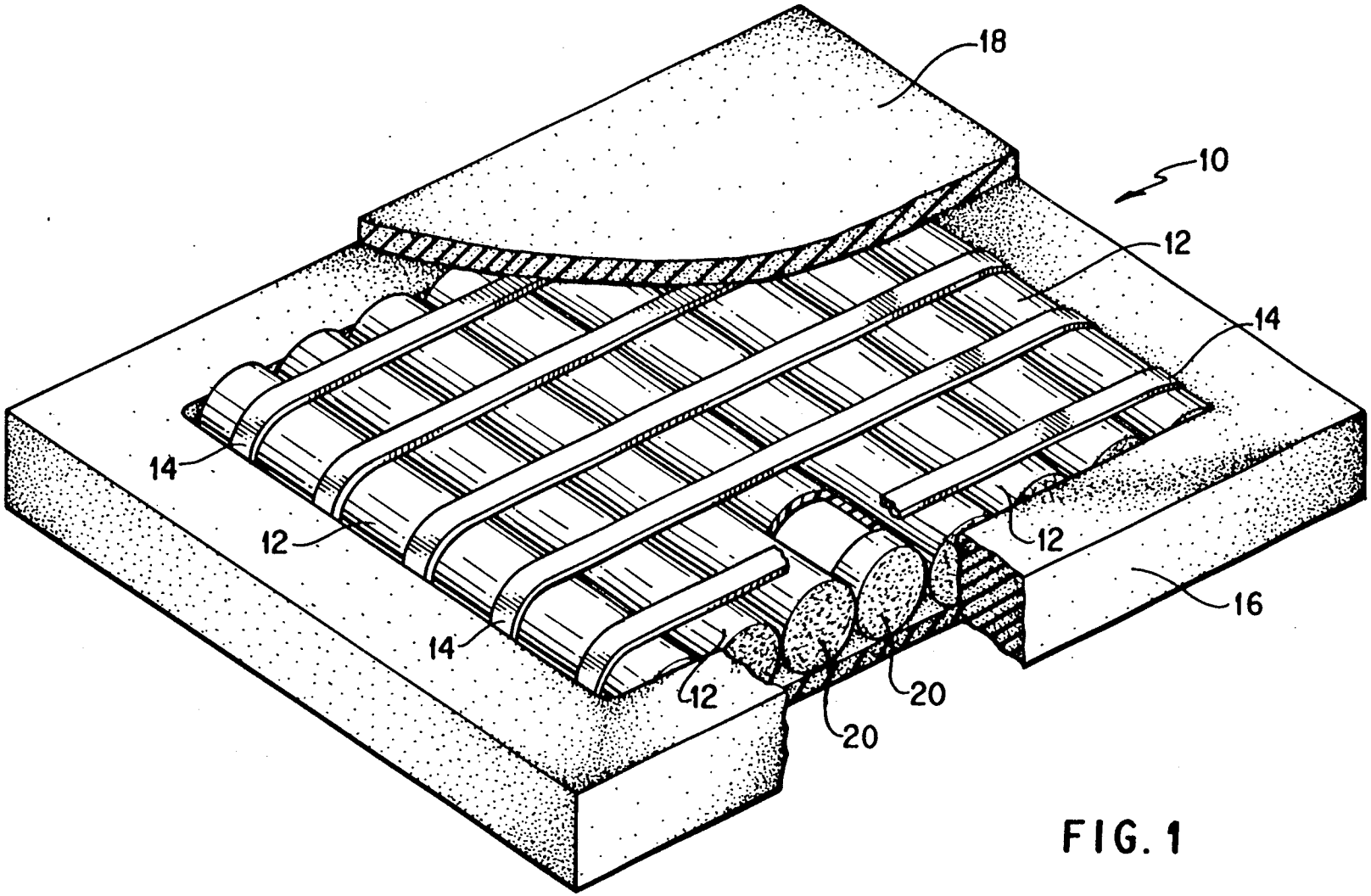
FIG. 1 is a perspective view of a preferred embodiment of a mattress having a construction according to the present invention, some of the components of the mattress being shown partially in section for greater clarity.

It should be noted that in some of the drawing figures, the dimensions such as thicknesses of the various components have not been shown to scale for purposes of clarity.

DETAILED DESCRIPTION OF THE PREFERRED EMBODIMENTS

Referring first to FIG. 1, shown is mattress assembly 10 having a construction in accordance with the present invention, some of the components of the mattress being shown in section for additional clarity. Mattress 10 in this preferred embodiment comprises an array of a plurality of elongated, hollow tubular structures 12 arranged in a generally parallel relationship to one another, that is, the axis of each tubular structure is generally parallel to an adjacent tubular structure. The longitudinal axes of tubular structures 12 preferably are also in generally a common plane such that the upper surfaces of the tubular structures lie in a common plane. The upper portion of each of tubular structures 12 taken together define a sleeping or resting surface.

The array of tubular structures 12 is preferably maintained in the shown close parallel relationship to one another by confining means such that the individual structures are restrained from moving apart from each other when subjected to various forces either from the side or from the top and the bottom. In the preferred embodiment of mattress structure shown, the confining means includes a plurality of straps 14 extending about the array of tubular structures 12 in a direction transverse to the longitudinal axes of the structures. Such straps 14 can be made of, for example, cloth, polymeric material, leather and the like and the number of straps or bands used may vary considerably. It is also contemplated that this type of confining means could be in the form of one strap having width approaching the length of the tubular structures 12 or even a flexible bag-like enclosure about the entire array of tubular structures.

The confining means in this embodiment further includes frame 16 about the periphery of the array of tubular structures 12 and also underlying the structures thereby forming a base. The illustrated frame 16 is composed of foam-like material such as a conventional polyurethane foam and is formed in an integral member including a bottom underlying the array of structures 12 and four side walls about the periphery of the array of structures. It should be noted that the height of the side walls forming frame 16 in this embodiment is slightly less than the height of tubular structures 12.

Overlying the top surfaces of tubular structures 12 and preferably the upper surfaces of side walls of frame 16 is flexible covering member 18. Although only a portion of covering member 18 is shown in FIG. 1, preferably the member overlies the entire upper surface of mattress 10. Covering member 18 as illustrated comprises a foam material but may be formed of other suitable cushioning materials or composites, the basic function of the covering member being to provide a slight cushioning effect to a person lying upon mattress 10. Other suitable materials for covering member 18 includes conventional bedding materials such as felt, quilting, sisal and the like and further includes a pneumatic type covering member which may be one or closed chambers filled with a fluid such as water or air. The thickness and material for covering member 18 should be selected such that the cover is flexible and that the desired cushioning effect is achieved but not to such extent that the beneficial features of the array of elongated tubular structures 12 beneath the covering member cannot be realized and appreciated as is set forth hereinafter.

As was previously mentioned, tubular structures 12 are elongated, that is, have a length greater than their largest dimension in cross-section, and are generally hollow with the interior volume open to the atmosphere, that is, are not closed structures nor having a chamber containing a fluid under pressure other that ambient. Generally, the length of tubular structures 12 is approximately equal to width of standard bed such as single, double, queen and the like. However it is contemplated by the present invention that the structures could be less than a standard width and two or more tubular structures laid end to end could be utilized. Alternatively, tubular structures 12 could extend from end to end of the mattress, that is from head to foot as applied to conventional mattresses.

Figure 2:
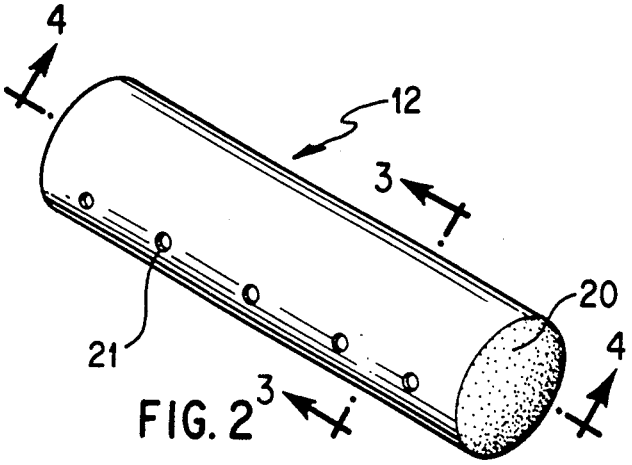
FIG. 2 is a detailed perspective view of an elongated tubular structure similar to that shown in FIG. 1.
Figure 3:
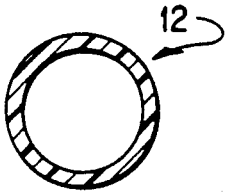
FIG. 3 is a cross-sectional view of the elongated tubular structure shown in FIG. 2 taken along line 3—3.
Figure 4:
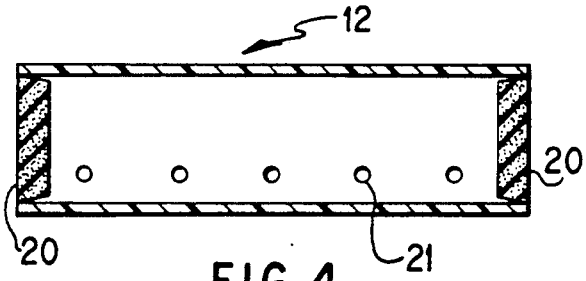
FIG. 4 is a cross-sectional view of the elongated tubular structure shown in FIG. 2 taken along line 4—4.

In the embodiment shown in FIG. 1, tubular structures 12 are hollow cylinders of circular cross-section having a wall thickness which is quite small compared to the cross-sectional diameter of the cylinder as is best shown in FIGS. 3 and 4. It should be noted that the length of tubular structures 12 shown in FIGS. 2 and 4 has been shortened for clarity. Tubular structures having a circular cross section from about 8 inches to about 15 inches or more have been found particularly satisfactory for the purposes of the present invention in making various cushions such as mattresses. Tubular structures having dimensions either greater or less than mentioned above may also be used in mattresses as well as in other applications.

The tubular structures can be constructed from a wide variety of materials in accordance with the concepts of the present invention. As was previously mentioned, the tubular structures should be constructed from a material of sufficient thickness that the resultant structure is not only self-supporting but also can support the weight of one or more persons lying on an array of such structures. Furthermore, the construction of the tubular structures should be such that they are resilient or slightly bendable under the forces encountered from the weight of a person so that the array of structures will be comfortable to a person resting thereon. A presently preferred material for fabricating the tubular structures is a polycarbonate polymeric material such as that sold under the tradename "Lexan" by the General Electric Company, Pittsfield, Mass., U.S.A. It has been found that extremely satisfactory tubular structures may be made from this material using a wall thickness of about 0.40 to 0.80 inches or more for structures having, for example, a diameter of about 12 to 15 inches. Clearly other polymeric materials such as polyamides having the suitable strength, flexibility, resiliency and formability can be utilized in forming the tubular structures. The wall thickness of such structures of other materials would be selected such that the resultant tubular structures would have characteristics very similar to those mentioned above with reference to polycarbonate tubular structures. In addition, various metals as well as composites such as impregnated fibrous materials, e.g., fiberglass, may also be suitable for use in fabricating the tubular structures. It is further contemplated that the tubular structures may be formed of laminates of two or more materials of disparate properties, such as, for example, laminates of a metal and a polymeric material or a laminate of two of more different polymeric materials.

Figure 11:
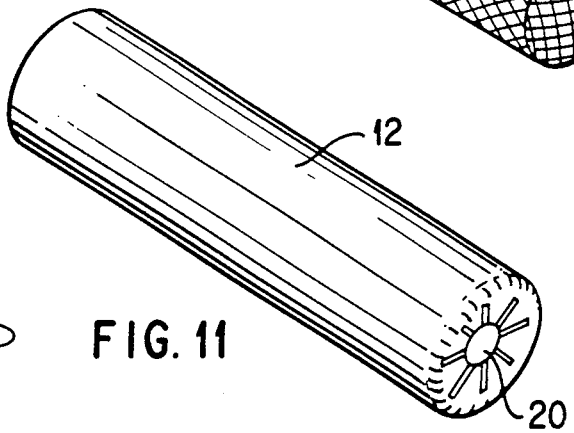
FIG. 11 is a perspective view similar to that of FIG. 2 showing an alternate form of an end insert.

In the embodiment of the tubular structures of the invention as shown in FIG. 1, 2 and 4, tubular structures 12 have their ends closed by plugs or inserts 20. These inserts 20 for tubular structures 12 have a shape conforming with the cross-sectional shape of the structures, e.g., circular, and of length much less than the length of the structures. The purpose of inserts 20, among other things, is to strengthen the ends of the tubular structures, not to form an enclosed chamber within the structures for the purposes of retaining the fluid contained therein. By strengthening the ends of tubular structures 12, the structures are better able to withstand the forces encountered when, for example, a person or persons sits on the edge of the mattress prior to lying down. With this particular purpose of the inserts 20 in mind, the inserts can take a variety of forms such as a spoked type wheel form as shown in FIG. 11 and can be made of wide variety of materials. A presently preferred material for the inserts is a foam material such as those which can be utilized in the previously mentioned frame.

It should be noted that in FIGS. 2 and 4, tubular structures 12 are provided with one or more holes 21 which may be used to vary the load bearing characteristics of the tubular structures. Holes 21 can also serve as a ventilating means or pressure relief means for the air contained in the interior of tubular structures 12.

While the cross-section of tubular structures 12 illustrated in FIGS. 1 through 4 is generally circular, it is contemplated by the present invention that the tubular structures can have a wide variety of shapes when viewed in cross-section. For example, reference is made to FIGS. 5 through 9, 12 and 13 where other suitable cross-sectional configurations for the tubular structures are shown. A common characteristic of these shapes for the tubular structures is that the upper or top surface includes one or more arcs or curves and that the central portion of the structure, that is, the portion of the wall immediately above the longitudinal axis of the structure, is generally the highest point of the structure. As a consequence of this latter feature, an array of closely arranged tubular structures will have a regular, rippled or corrugated type upper surface which is a major contributing factor in the improved performance of the mattress of the present invention.

Figure 5:
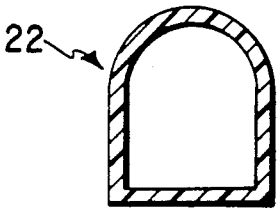
FIG. 5 is a cross-sectional view of another embodiment of an elongated tubular structure which may be used in the mattress of the present invention.
Figure 6:
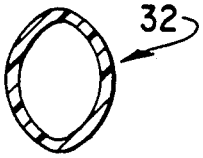
FIG. 6 is a cross-sectional view of another embodiment of an elongated tubular structure which may be used in the mattress of present invention.

More specifically, FIG. 5 illustrate a cross-sectional shape of tubular structures 22 that may be described as semi-domed having a curved upper wall, and with planar side walls and a planar bottom wall together forming a rectangular type shape. The outwardly curved upper or top wall completes the closed tubular structure as viewed in cross-section to provide strength and rigidity. FIG. 6 illustrates what can be described as an oval type structure where the width of tubular structures 32 is greater in one direction than a perpendicular direction. It is contemplated that tubular structure 32 such as that shown in FIG. 6 could be utilized in the orientation shown where the largest dimension extends from top to bottom or in where the structure is rotated by ninety degrees such that the smallest dimension extends from top to bottom, although the former orientation is presently preferred.

Figure 7:
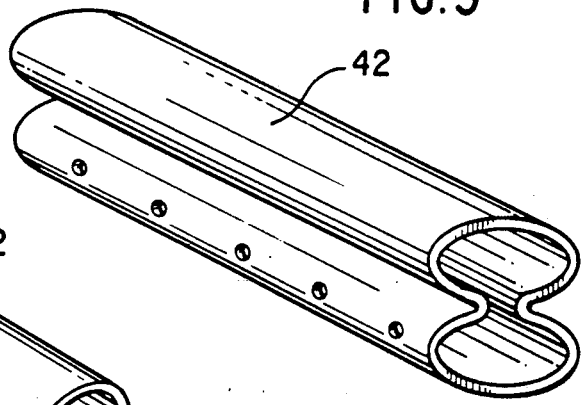
FIG. 7 is a perspective view of yet another embodiment of an elongated tubular structure which may be used in the mattress of the present invention.

FIG. 7 shows yet another configuration for a tubular structure for the present invention. Here structure 42 has a cross-section where the top and bottom of the cross-section are outwardly curved and the side sections are a reverse inward curve. Unlike the embodiment shown in FIG. 6, this shape for tubular structure 42 would not be generally suitable for the purposes of the present invention when rotated ninety degrees from the orientation shown since the upper portion would then not present an outwardly curved surface. An advantage of the configuration for the embodiment of tubular structures 42 shown in FIG. 7 is that when the structures are subjected to a downwardly directed force and the structure deforms in response thereto, the direction of movement of the side walls during such a deformation tends to be inward toward the longitudinal axis of the structure. Thus the overall dimensions of an array of such structures would not vary considerably during loading of the structures and therefore, greater freedom for deformation and increased comfort for a user are thereby achieved.

Figure 8:
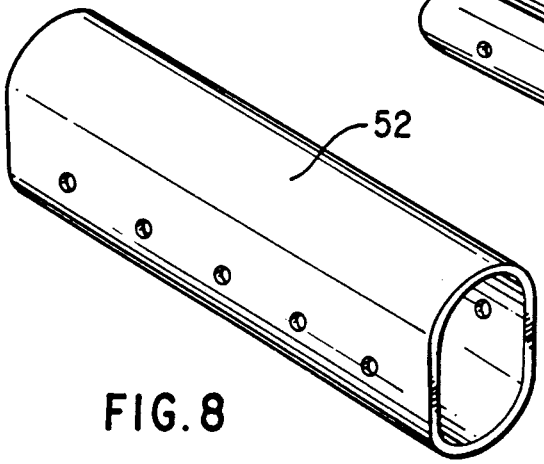
FIG. 8 is a perspective view of yet another embodiment of an elongated tubular structure which may be used in the mattress of the present invention.

FIG. 8 illustrates yet another cross-sectional shape for a tubular structure. This shape for tubular structure 52 in its unloaded condition as shown can best be described as being circular in its upper and lower portions and flattened along the lateral sides. Like the embodiment shown in FIG. 7, this tubular structure is best utilized in the orientation shown, that is, with the rounded portion being the surface contacted by the human body when in use.

Figure 9:
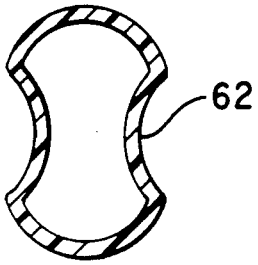
FIG. 9 is a cross-sectional view of still another embodiment of an elongated tubular structure which may be used in the mattress of the present invention, the structure being somewhat similar to the structure shown in FIG. 7.

FIG. 9 illustrates a variant on the shape of the tubular structure shown in FIG. 7 where the inwardly curved side walls of tubular structure 62 have a gentler or more rounded curvature. This embodiment would tend to function in the same or similar manner to the embodiment shown in FIG. 7.

Figure 10:
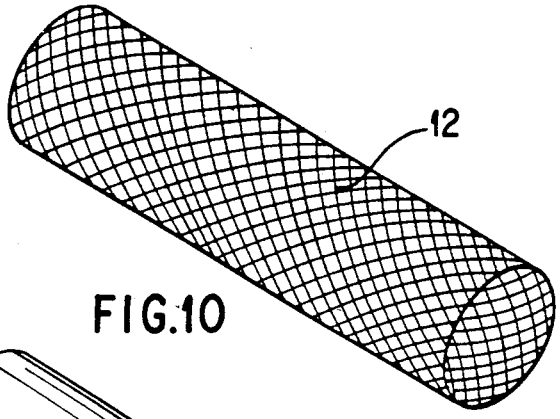
FIG. 10 is a perspective view of another embodiment for an elongated tubular structure.

Tubular structure 72 as shown in FIG. 10 illustrates the use of meshed type material in forming the walls of the structure as opposed to a generally continuous type sheet. The use of mesh type material may decrease material costs if made of suitable material. Metals may be particularly suitable in forming meshed type tubular structures 72.

As was mentioned previously, other configurations and structures may be used for inserts in the end of the tubular structures, one example being shown in FIG. 11. As shown, insert 20 has a configuration very similar to that of a spoked wheel with a central portion and radial spokes extending therefrom. It should be noted that the ends of the walls of structure 12 have been deformed about the peripheral edges of insert 22 to help maintain the insert in the end of the structure. A somewhat simpler version of this basic concept would be the utilization of just two spokes extending from one wall to the other wall through the center of the cross-section, preferably oriented in the vertical direction. An example of such an insert (not shown) is a rod or bar of suitable length to extend across the tubular structure.

Figure 12:
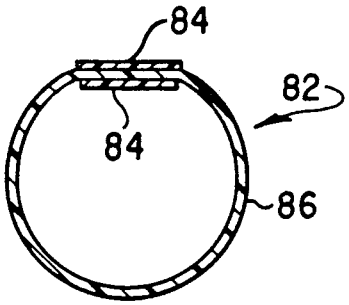
FIG. 12 is a cross-sectional view of another embodiment of an elongated tubular structure which may be used in the mattress of the present invention.

FIG. 12 illustrates yet another cross-sectional shape for a tubular structure. This shape of tubular structure 82 in its unloaded condition as shown can best be described as being circular in its lower portion and flattened in the upper portion of the curvature. Such a shape for a tubular structure may be achieved by affixing two strips 84 of at least semi-rigid material to one of the edges of sheet 86 of material for forming a tubular structure, the strips as affixed extending outwardly from the edge of the sheet so as to form a longitudinal slot. The edge of sheet 86 opposite from the edge having the strips affixed thereto is then brought about such that the sheet forms a generally circular shape and the free edge of the sheet is inserted into the slot formed by the strips. The free end of sheet 86 is then secured within the slot. Depending upon how far strips 84 overlap each edge of sheet 86 and thus create a triple thickness of material which generally determines how much the upper portion of the structure assumes a flattened shape relative to the remainder of the structure. Of course, strips 84 should not provide too much rigidity to that portion of tubular structure 82 such that it does not have an upwardly curved shape when used as top or upper surface of the structure. On the other hand, if the flattened portion of structure 82 is oriented downwardly when in use in the mattress of the present invention, the joint provided by the strips may even be planar across a portion or even the entire width of the structure.

Figure 13:
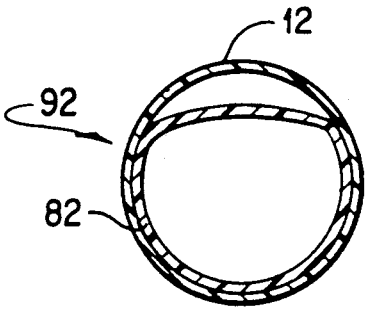
FIG. 13 is a cross-sectional view of another embodiment of an elongated tubular structure which may be used in the mattress of the present invention.

FIG. 13 is cross-sectional view of a composite tubular structure formed from a structure such as that shown in FIG. 12 inserted within a structure having a circular cross-section such as that shown in FIGS. 2 through 4. One advantage of tubular structure 92 shown in FIG. 13 is that the outer circular structure 12 provides the same characteristics upon loading as does a single circular tubular structure up to a certain loading point as which time the outer structure will have deformed sufficiently so as to contact the inner structure 82 such as that shown in FIG. 12. As a consequence, composite tubular structure 92 would tend to resist extremely heavy loading rather than collapsing.

Figure 14:
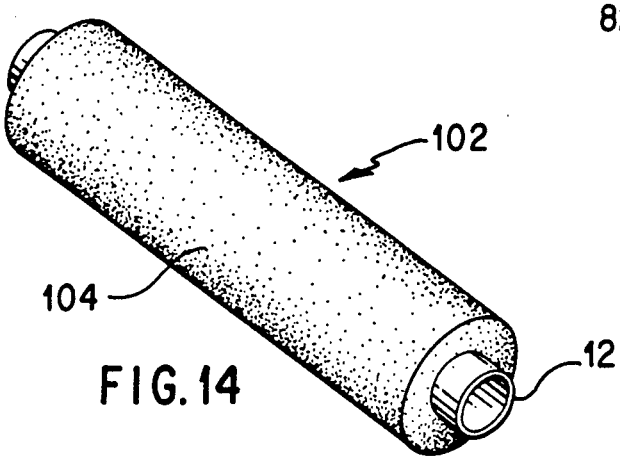
FIG. 14 is a perspective view of yet another embodiment of an elongated tubular structure which may be used in the mattress of the present invention.

FIG. 14 illustrates a tubular structure 102 including a structure 12 such as that shown in FIG. 2 which has been covered with layer 104 of foam like material. With such a construction for tubular structure 102, cover 18 as illustrated in FIG. 1 could be dispensed with or be of a lesser thickness. Alternatively, tubular structure 102 of FIG. 14 could be used with the same cover member 18 to provide greater overall softness for the mattress assembly. The thickness and type of foam material used for layer 104 may vary considerably.

Figure 15:
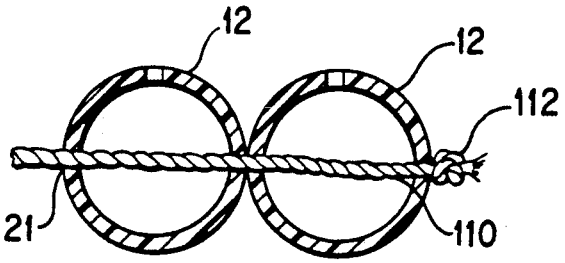
FIG. 15 is a cross-sectional view of two adjacent elongated tubular structures illustrating another manner of maintaining the structures confined relative to each other.

FIG. 15 illustrates another confining means which may to used to hold tubular structures 12 together in forming a cushion such as a mattress according to the present invention. As shown, each tubular structure is provided with at least two holes 21 preferably opposed to one another and having an elongated element 110 extending through the holes which in turn extends through similar holes in adjacent tubular structures 12. Elongated element 110 may be flexible such as the rope shown or a plastic tube or may be semi-rigid or rigid such as, for example, a rod or the like. The distal end of element 110 may be provided with stop means 112 such as a knot in the case of a flexible element or a enlargement or clamp in the case of a rigid element. Such a stop means 112 serves to confine the structures in the array such that the configuration and integrity of the array is maintained. While only one element 110 may be used with a particular array of tubular structures 12, it is presently preferred that a plurality of elements be used in an array, the number being used generally depending upon the characteristics desired from the mattress and the overall length of the structure or structures.

Figure 16:
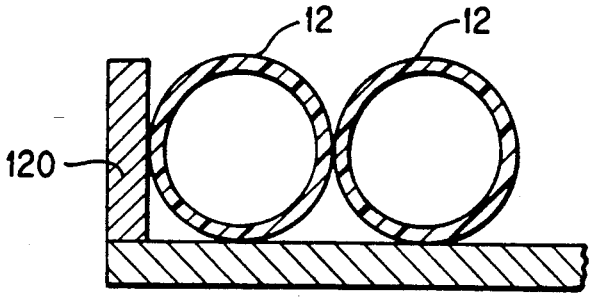
FIG. 16 is a cross-sectional view of two adjacent elongated tubular structures illustrating several other manners for maintaining the structures confined relative to each other, and, FIG. 17 is a perspective view of a plurality of elongated tubular formed together in an integral manner.

FIG. 16 illustrate another confining means for an array of tubular structures 12 as well as another embodiment for a frame. The confining means shown is simply the provision of affixing or securing contacting surfaces of adjacent tubular structures 12 to one another. The surfaces of structures 12 may be affixed by any suitable means including fasteners such as staples, rivets and the like as well as adhesives. A presently preferred means for affixing tubular structures 12 of polycarbonate material to one another is to apply a coating of suitable solvent such as methylene chloride to the contacting surfaces and then press these surfaces together.

As was mentioned above, FIG. 16 also shows a another embodiment for a frame for helping confine tubular structures 12 relative to each other. The frame 120 therein is of a rigid material such as wood and provides a planar bottom surface and planar enclosing side walls to help retain tubular structures 12 in an array. Such a frame 120 can be constructed in a variety of manners as is apparent to those of skill in the art to which the present invention pertains. Like frame 16 shown in FIG. 1, preferably the side walls of frame 28 extend below the level of the top of tubular structures 12.

Figure 17:
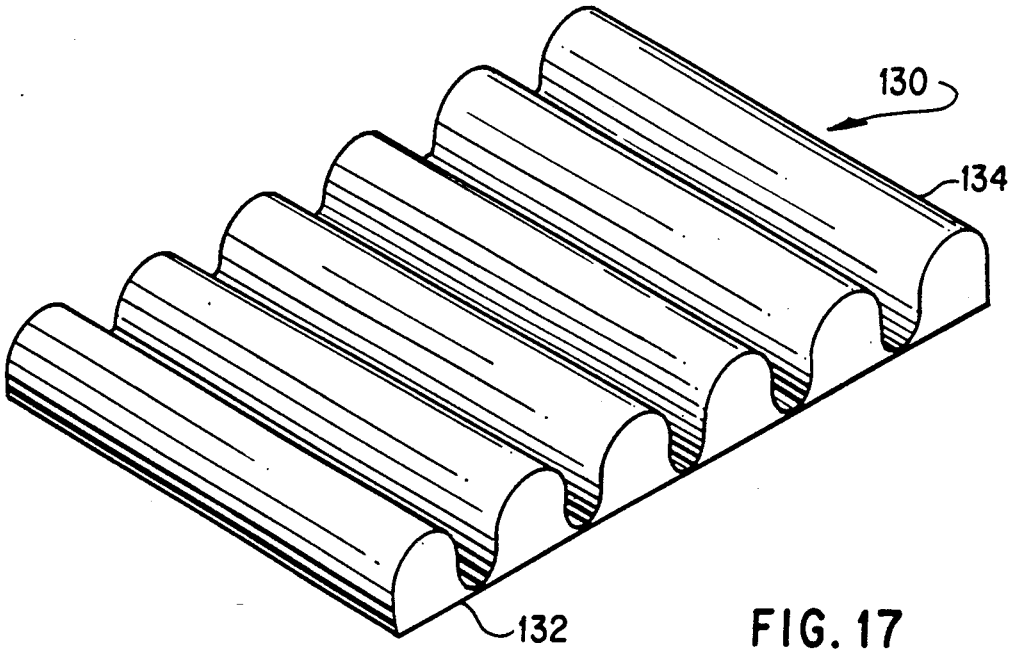

FIG. 17 illustrates a manner in which a plurality of tubular structures can be formed unitarily by structure 130. In this embodiment, a large sheet 131 of suitable flexible material is folded back on itself such that bottom portion 132 is planar and top portion 134 assumes a corrugated or rippled shape. Then, the points or lines of top portion 134 which contact bottom planar portion 132 are affixed or secured in a suitable manner such a welding, e.g., ultrasonic welding or by some suitable adhesive or by fusion caused by heat, solvents and the like. The composite structure 130 thus comprises a plurality of parallel tubular structures similar to that shown in FIG. 5 which are at least in part integral with each other and permanently secured in the arranged configuration.

Figure 18:
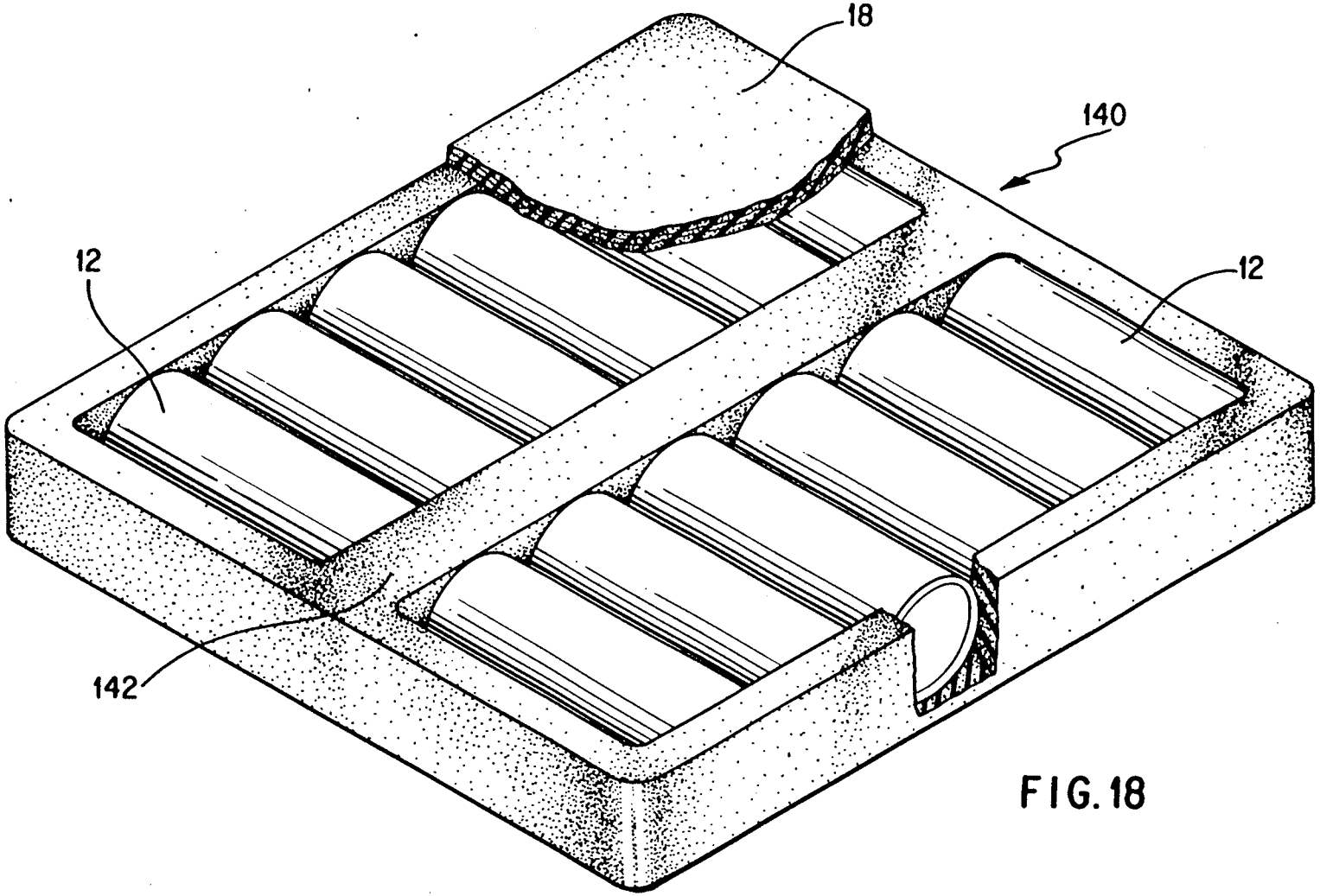
FIG. 18 is a perspective view of another embodiment of a mattress having a construction according to the present invention, some of the components of the mattress being shown partially in section for greater clarity.

FIG. 18 shows another embodiment of a confining means or frame which is quite similar to that shown in FIG. 1, the main difference being that frame 140 is provided with central divider portion 142 and thus two arrays of tubular structures are confined by the same confining means. Generally this type of frame 140 is utilized in a mattress construction adapted for use by two persons comparable to a double bed and the like. An advantage of this type of frame is that each array of tubular structures 12 can be formed of tubular structures of different characteristics from each other and thus the overall mattress can be custom made for each individual of the couple using the mattress.

While the arrangement or array of tubular structures 12 shown in the various Figures in forming a mattress according to the invention utilize tubular structures of the same size and thus having the same height, it is within the scope of the invention to incorporate various sized tubular structures in a particular array such that the formed sleeping or resting surface is not of same elevation throughout when not under a load. While the reasons for using various sized tubular structures may vary considerably, it may be advantageous to use larger sized tubular structures for those areas which are expected to experience the greatest loading such that when the mattress is subjected to load and ultimate deformation, the resultant sleeping or supporting surface defined by the tops of the tubular structures will tend to be even or planar. Other advantages to arrangements of structures of varying heights will be apparent to those of skill in the art.

As was mentioned previously, an important feature of the invention is that a cushion such as a mattress includes a plurality of tubular structures having a round or curved upper body engaging surface formed or a material in such dimensions that the structures exhibit a certain degree of resiliency so as to provide sufficient degree of comfort for a person lying thereon and also of sufficient rigidity so as to provide the support necessary to maintain the general configuration of the structures and support for all portions of the body resting thereon. As a result, the mattress provides a sleeping or resting surface which enables a user to obtain a restful and comfortable nights sleep and generally pain and ache free condition when arising from the sleeping surface.

While there has been shown and described what is considered to be preferred embodiments of the present invention, it will be apparent to those skilled in the art to which the invention pertains that various changes and modifications may be made therein without departing from the invention as defined in the appended claims.

It is claimed:

1. A cushion comprising a plurality of elongated tubular structures each having a longitudinal axis, the tubular structures being arranged in an array such that adjacent structures contact each other and the axes of adjacent structures are generally parallel to each other, each structure having an interior open to the atmosphere and having a strengthening element adjacent one end of the structure, the element having a length much less than that of the structure, each structure also being resilient in nature and having an upwardly extending rounded surface, the upper portions of the tubular structures together defining a generally horizontal sleeping surface, and confining means for maintaining the tubular structures in the arranged array.

2. A cushion in accordance with claim 1 wherein the tubular structures have a circular cross-section when not under load.

3. A cushion in accordance with claim 1 wherein the tubular structures have an oval cross-section.

4. A cushion in accordance with claim 1 wherein the tubular structures have a cross-section which is circular in one portion and a flattened portion relative to the circular portion when not under load.

5. A cushion in accordance with claim 1 wherein the tubular structures have a cross-section which is outwardly rounded in the top and bottom portions and essentially planar on the side portions.

6. A cushion in accordance with claim 1 wherein the tubular structures have a cross-section which is outwardly rounded in the top portion and inwardly rounded in the side portions.

7. A cushion in accordance with claim 6 wherein the bottom portion of the tubular structures have an outwardly rounded cross-section.

8. A cushion in accordance with claim 1 wherein the confining means includes a frame about the tubular structures.

9. A cushion in accordance with claim 8 wherein the frame comprises side walls about the tubular structures and a bottom beneath the structures.

10. A cushion in accordance with claim 9 wherein the frame includes a divider wall intermediate of the side walls.

11. A cushion in accordance with claim 1 wherein the confining means includes a strap about the tubular structures.

12. A cushion in accordance with claim 1 wherein the confining means includes an element extending from one structure to another.

13. A cushion in accordance with claim 12 wherein the element is a flexible member extending through a hole in the tubular structures.

14. A cushion in accordance with claim 12 wherein the element is a rod member extending through a hole in the tubular structures.

15. A cushion in accordance with claim 1 wherein the tubular structure is of a polymeric material.

16. A cushion structure in accordance with claim 1 wherein the tubular structures are formed of a mesh like material.

17. A cushion in accordance with claim 1 wherein at least one of the tubular structures has a layer of foam material about its exterior surface.

18. A cushion in accordance with claim 1 wherein the array of tubular structures comprises a sheet folded on itself with a planar bottom portion and a corrugated upper portion, the upper portion being secured at various points to the bottom portion.

19. A cushion in accordance with claim 1 wherein the strengthening element has a shape conforming with the cross-sectional shape of the structures.

20. A cushion in accordance with claim 19 wherein the strengthening element is in the shape of a spoke type wheel.

21. A cushion in accordance with claim 19 wherein the strengthening element is of foam material in the form of a disc.

22. A cushion comprising a plurality of elongated tubular structures each having a longitudinal axis, the tubular structures having a cross-section which is outwardly rounded in the top and bottom portions and essentially planar on the side portions, the tubular structures being arranged in an array such that adjacent structures contact each other with their respective axes generally parallel, the interior of each structure being open to the atmosphere and each structure being resilient in nature, the upper portions of the tubular structures together defining a generally horizontal sleeping surface, and confining means for maintaining the tubular structures in the arranged array.

23. A cushion comprising a plurality of elongated tubular structures each having a longitudinal axis, the tubular structures having a cross-section which is outwardly rounded in the top portion and inwardly rounded in the side portions, the tubular structures being arranged in an array such that adjacent structures contact each other with their respective axes generally parallel, the interior of each structure being open to the atmosphere and each structure being resilient in nature and having an upwardly extending rounded surface, the upper portions of the tubular structures together defining a generally horizontal sleeping surface, and confining means for maintaining the tubular structures in the arranged array.

24. A cushion in accordance with claim 23 wherein the bottom portion of the tubular structures have an outwardly rounded cross-section.

* * * * *